US008290382B2

(12) United States Patent
Hiroi

(10) Patent No.: US 8,290,382 B2
(45) Date of Patent: Oct. 16, 2012

(54) IMAGE FORMING APPARATUS

(75) Inventor: Toshiaki Hiroi, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 406 days.

(21) Appl. No.: 12/727,599

(22) Filed: Mar. 19, 2010

(65) Prior Publication Data

US 2010/0239281 A1 Sep. 23, 2010

(30) Foreign Application Priority Data

Mar. 23, 2009 (JP) ..... 2009-069496

(51) Int. Cl.
*G03G 15/00* (2006.01)

(52) U.S. Cl. ..... 399/44; 399/43

(58) Field of Classification Search ..... 399/44, 399/43, 66, 76, 94
See application file for complete search history.

(56) References Cited

U.S. PATENT DOCUMENTS

| | | | | |
|---|---|---|---|---|
| 7,991,309 | B2 * | 8/2011 | Hiroi | 399/43 |
| 2001/0022907 | A1 | 9/2001 | Fukao et al. | |
| 2003/0058328 | A1 | 3/2003 | Yokoi | |
| 2008/0044192 | A1 | 2/2008 | Yagawara et al. | |
| 2008/0112718 | A1 * | 5/2008 | Akashi et al. | 399/49 |

FOREIGN PATENT DOCUMENTS

| | | | |
|---|---|---|---|
| JP | 07-140734 | | 6/1995 |
| JP | 7-271116 | A | 10/1995 |
| JP | 2000-321932 | A | 11/2000 |
| JP | 2001-34115 | A | 2/2001 |
| JP | 2001-305811 | | 11/2001 |
| JP | 2003-98934 | A | 4/2003 |
| JP | 2003-302878 | A | 10/2003 |
| JP | 3744670 | | 2/2006 |
| JP | 2007-298773 | | 11/2007 |

OTHER PUBLICATIONS

European Search Report date Dec. 17, 2010, issued in the corresponding European Patent Application No. 10003002.2-1240.

Office Action (Notification of Reasons for Refusal) dated Feb. 1, 2011, issued in the corresponding Japanese Patent Application No. 2009-069496, and an English Translation thereof.

* cited by examiner

*Primary Examiner* — Walter L Lindsay, Jr.
*Assistant Examiner* — Rodney Bonnette
(74) *Attorney, Agent, or Firm* — Buchanan Ingersoll & Rooney PC

(57) ABSTRACT

An image forming apparatus includes an image carrier, a transfer member provided at a position at which the transfer member can be pressed against the image carrier, a detection device for detecting a toner attachment amount of the toner image formed on the image carrier, an avoidance judging section for judging whether or not avoidance of a pressed region should be performed when a toner image for image formation is formed on the image carrier, the pressed region serving as a region located on the image carrier and being pressed against the transfer member from the end of a previous image forming operation to the start of a present image forming operation, and an avoidance continuation judging section for judging the necessity for continuation of the avoidance by being operated when it is judged as avoidance by the avoidance judging section.

12 Claims, 11 Drawing Sheets

IMAGE FORMING APPARATUS

This application is based on application No. 2009-069496 filed in Japan, the contents of which are hereby incorporated by reference.

BACKGROUND OF THE INVENTION

1. Field of the Invention

The present invention relates to an image forming apparatus such as a copier, a printer, a FAX or a multifunction device thereof, in which electrophotographic technology is utilized.

2. Description of the Related Art

A transfer member such as a transfer roller is formed of a conductive rubber or the like, and this rubber contains components such as: a residue of an initiator; a by-product produced at the time of a reaction; a low molecular component of a base polymer; and a vulcanizing agent, a softener and a plasticizer, which are added at the time of rubber roller molding. Further, when the transfer member and image carrier are left in a pressed state over a long period of time, the above-mentioned components seep (bleed) through the transfer member, and contaminate the image carrier, which might result in the formation of a contaminated region in the image carrier. Furthermore, in this contaminated region, transfer cannot be properly carried out, and an irregular image in the form of a lateral streak (i.e., a white spot image) might occur. A phenomenon in which such a white spot image occurs is promoted in accordance with the temperature of inside of an image forming apparatus in particular.

In order to eliminate the inconveniences described above, there have been disclosed a technique in which a contaminated region of an image carrier is not used as an image region as described in Japanese Unexamined Patent Application Publication No. 2003-98934 (Patent Document 1), and a technique in which a contaminated region of an image carrier is removed before image formation as described in Japanese Unexamined Patent Application Publication No. 2001-34115 (Patent Document 2).

However, if a non-image region is constantly provided on an image carrier to limit an image region as described in Patent Document 1, productivity is reduced when a large number of images are formed. On the other hand, if a contaminated region is removed before image formation as described in Patent Document 2, it is necessary to rotate a photosensitive body for a given period of time after a print instruction from a user has been received, and therefore, first print time is prolonged, which might cause the user to feel stressed.

Moreover, in order to eliminate the foregoing phenomenon, studies have also been conducted on avoidance of image formation for only a given number of sheets in a region where an image carrier and a transfer member are pressed against each other. However, since image formation is avoided for only a preset number of sheets, it is conceivable that the preset number of avoided sheets and the number of avoided sheets, which is actually necessary for removal of contamination, might be different depending on actual user's usage status and/or an environment in which an image forming apparatus is installed.

SUMMARY OF THE INVENTION

A first invention of the present application provides an image forming apparatus including: an image carrier; a toner image formation mechanism for forming a toner image on the image carrier; a transfer member, provided at a position at which the transfer member can be pressed against the image carrier, for transferring the toner image, formed on the image carrier, onto a transferred material; a detection device for detecting a toner attachment amount of the toner image formed on the image carrier; and a control section, wherein the control section includes: an avoidance judging section for judging whether or not avoidance of a pressed region should be performed when a toner image for image formation is formed on the image carrier, the pressed region serving as a region located on the image carrier and being pressed against the transfer member from the end of a previous image forming operation to the start of a present image forming operation; and a first avoidance continuation judging section for judging the necessity for continuation of the avoidance by being operated when it is judged by the avoidance judging section that the "avoidance should be performed", and wherein the first avoidance continuation judging section includes: a recognition part for recognizing the position of the pressed region; a first formation part for forming a detection toner image on the pressed region and an adjacent region of the pressed region by the toner image formation mechanism; a first detection part for detecting, by the detection device, a toner attachment amount of the detection toner image formed on the pressed region and a toner attachment amount of the detection toner image formed on the adjacent region of the pressed region; and a first decision part for calculating a difference between both of the toner attachment amounts, thus deciding the necessity for continuation of the avoidance based on whether or not this difference falls within a given range.

A second invention of the present application provides an image forming apparatus including: an image carrier; a toner image formation mechanism for forming a toner image on the image carrier; a transfer member, provided at a position at which the transfer member can be pressed against the image carrier, for transferring the toner image, formed on the image carrier, onto a transferred material; a detection device for detecting a toner attachment amount of the toner image formed on the image carrier; and a control section, wherein the control section includes: an avoidance judging section for judging whether or not avoidance of a pressed region should be performed when a toner image for image formation is formed on the image carrier, the pressed region serving as a region located on the image carrier and being pressed against the transfer member from the end of a previous image forming operation to the start of a present image forming operation; and a second avoidance continuation judging section for judging the necessity for continuation of the avoidance by being operated when it is judged by the avoidance judging section that the "avoidance should be performed", and wherein the second avoidance continuation judging section includes: a recognition part for recognizing the position of the pressed region; a second formation part for forming a detection toner image on the pressed region by the toner image formation mechanism; a second detection part for detecting, by the detection device, a toner attachment amount of the detection toner image formed on the pressed region; and a second decision part for deciding the number of continuations of the avoidance based on the toner attachment amount.

DETAILED DESCRIPTION OF THE INVENTION

First Embodiment

In the present embodiment, a four-tandem intermediate transfer type color image forming apparatus will be described by way of example. However, the present invention may be applicable to a four-cycle type or four-cycle intermediate transfer type color image forming apparatus in which toner images are sequentially formed on a single photosensitive body and transferred to a transfer member or an intermediate transfer body. Further, the present invention may be applicable to a tandem type color image forming apparatus having a plurality of photosensitive bodies and serving as a direct transfer type image forming apparatus in which a transfer member is sucked onto a transfer belt and conveyed thereon. Furthermore, the present invention may be applicable to a monochrome image forming apparatus.

Figure 1:
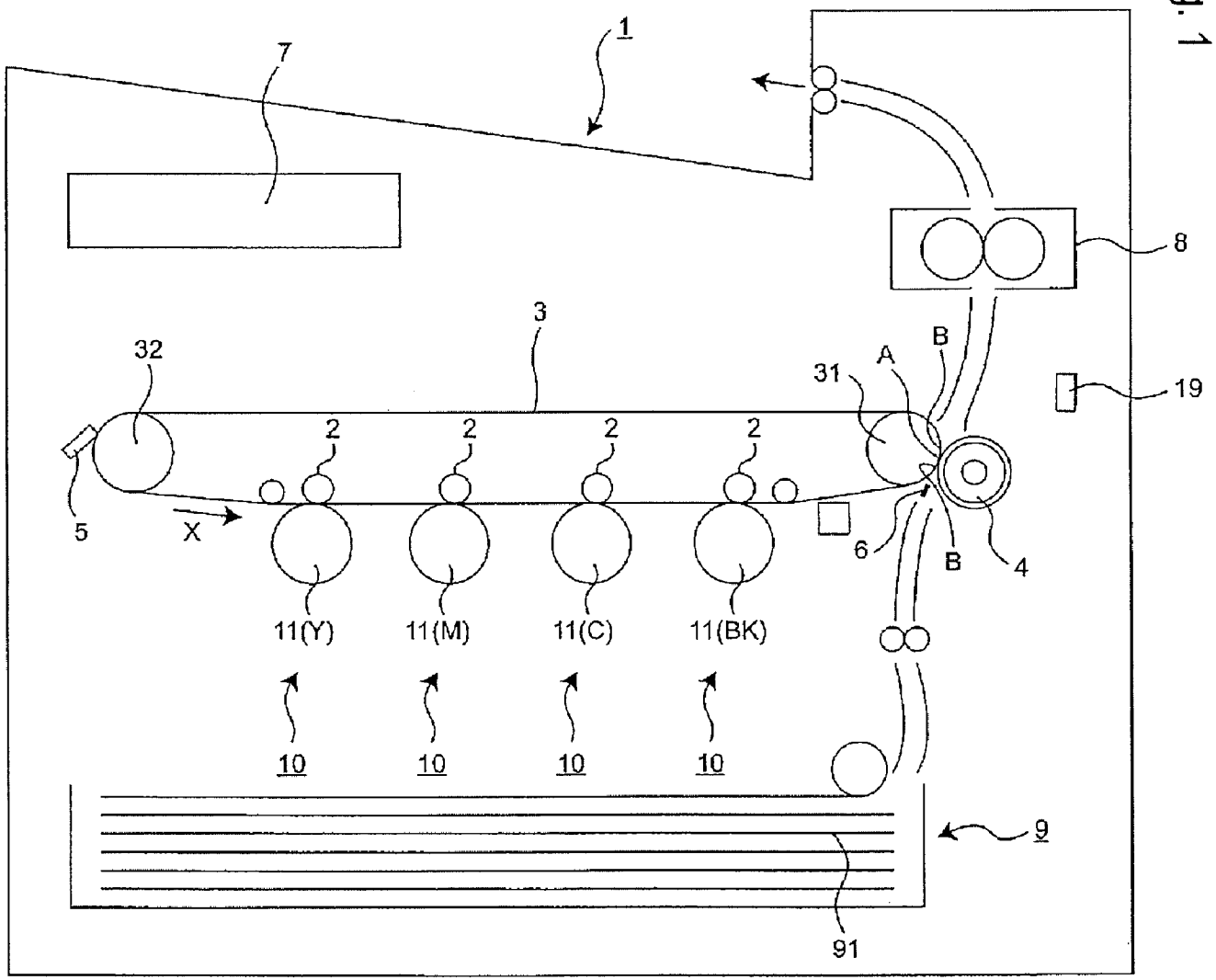
FIG. 1 is a conceptual diagram illustrating a four-tandem intermediate transfer type color image forming apparatus 1.

FIG. 1 is a conceptual diagram illustrating a four-tandem intermediate transfer type color image forming apparatus 1. The image forming apparatus 1 includes: toner image formation mechanisms 10; a secondary transfer roller 4; an optical sensor 6; a control section 7 for controlling operations of the image forming apparatus 1; and a paper feed unit 9. The toner image formation mechanisms 10 each have a primary transfer roller 2 serving as a primary transfer member, and each form a toner image on an intermediate transfer belt 3 serving as an image carrier. The secondary transfer roller 4 serving as a secondary transfer member transfers the toner image, which has been formed on the intermediate transfer belt 3, to a transferred material 91 supplied from the paper feed unit 9. The optical sensor 6 detects a toner attachment amount of the toner image formed on the intermediate transfer belt 3. The transferred material 91, on which the toner image has been transferred, is subjected to toner image fixation through a fixation device 8, and is then ejected therefrom.

The intermediate transfer belt 3 is extended between a drive roller 31 and a driven roller 32, and has an orbit in an X direction. In the vicinity of the driven roller 32, there is located a cleaning blade 5 for removing transfer residual toner remaining on the intermediate transfer belt 3.

The optical sensor 6 has a light emitting part and a light receiving part, and is provided at a position opposed to the intermediate transfer belt 3 so as to be able to detect the toner attachment amount of the intermediate transfer belt 3. In FIG. 1, the optical sensor 6 is provided within a range located downstream of a photosensitive body 11 (Bk) in the toner image formation mechanism 10 and upstream of the secondary transfer roller 4. However, the position at which the optical sensor 6 is located is not limited to the range illustrated in FIG. 1. A temperature sensor 19 is provided inside the image forming apparatus 1 so as to measure the temperature of inside of the image forming apparatus 1.

Figure 2:
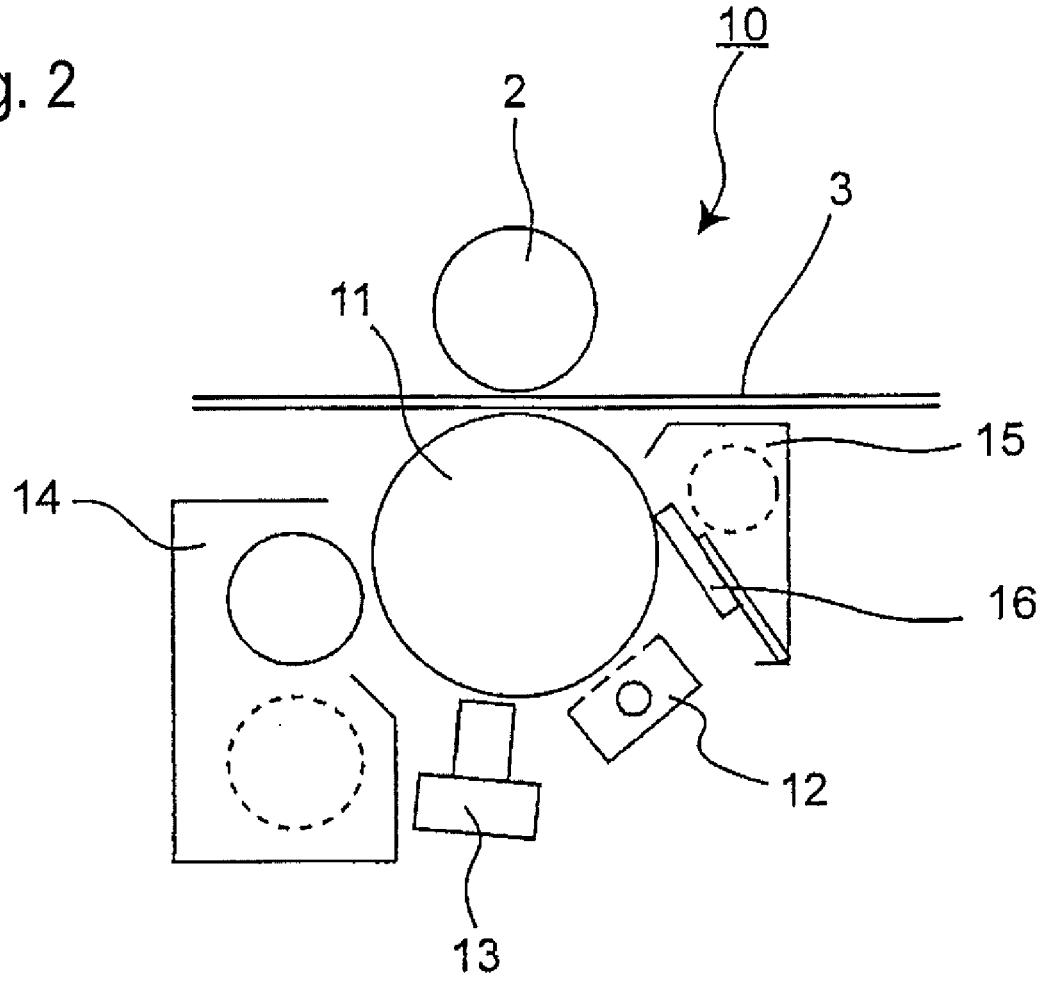
FIG. 2 is a conceptual diagram illustrating one of photosensitive body parts of FIG. 1.

FIG. 2 is a conceptual diagram illustrating one of the toner image formation mechanisms 10 of FIG. 1. As illustrated in FIG. 2, the toner image formation mechanism 10 includes: the primary transfer roller 2; the photosensitive body 11; a charging part 12 for electrically charging the photosensitive body 11; an exposure part 13 for forming an electrostatic latent image on the photosensitive body 11; a developing device 14 for developing, as a toner image, the electrostatic latent image on the photosensitive body 11; and a cleaner unit 15.

The toner image formation mechanism 10 transfers the toner image, which has been developed on the photosensitive body 11, onto the intermediate transfer belt 3 by means of the primary transfer roller 2, thereby forming a toner image for image formation on the intermediate transfer belt 3.

The cleaner unit 15 removes residual toner on the photosensitive body 11 by a cleaning blade 16, and collects the removed residual toner.

As illustrated in FIG. 1, toner images of respective colors formed on the photosensitive bodies 11 (Y: Yellow), 11 (M: Magenta), 11 (C: Cyan) and 11 (Bk: Black) are each subjected to primary transfer onto the intermediate transfer belt 3 by the associated primary transfer roller 2, and the respective colors are overlapped on the intermediate transfer belt 3, thus providing a four-color toner image. In this embodiment, the primary transfer rollers 2 have no mechanism for keeping a distance between the primary transfer rollers 2 and the intermediate transfer belt 3, and are thus constantly pressed against the intermediate transfer belt 3. The toner image on the intermediate transfer belt 3 is subjected to secondary transfer onto the transferred material 91 by the secondary transfer roller 4. Then, the toner image on the transferred material is fixed onto the transferred material by the fixation device 8, thus providing a color image. It should be noted that the secondary transfer roller 4 according to the present embodiment also has no mechanism for keeping a distance between the secondary transfer roller 4 and the intermediate transfer belt 3, and is thus constantly pressed against the intermediate transfer belt 3.

In this case, although parts in which pressed regions are formed in the image forming apparatus 1 include: a primary transfer part (i.e., a part in which transfer is performed on the intermediate transfer belt 3 by the primary transfer roller 2); and a secondary transfer part (i.e., a part in which transfer is performed on the transferred material by the secondary transfer roller 4), the secondary transfer part will be described by way of example in the present embodiment. In other words, the intermediate transfer belt 3 serves as the image carrier, and the secondary transfer roller 4 serves as the transfer member.

Figure 3:
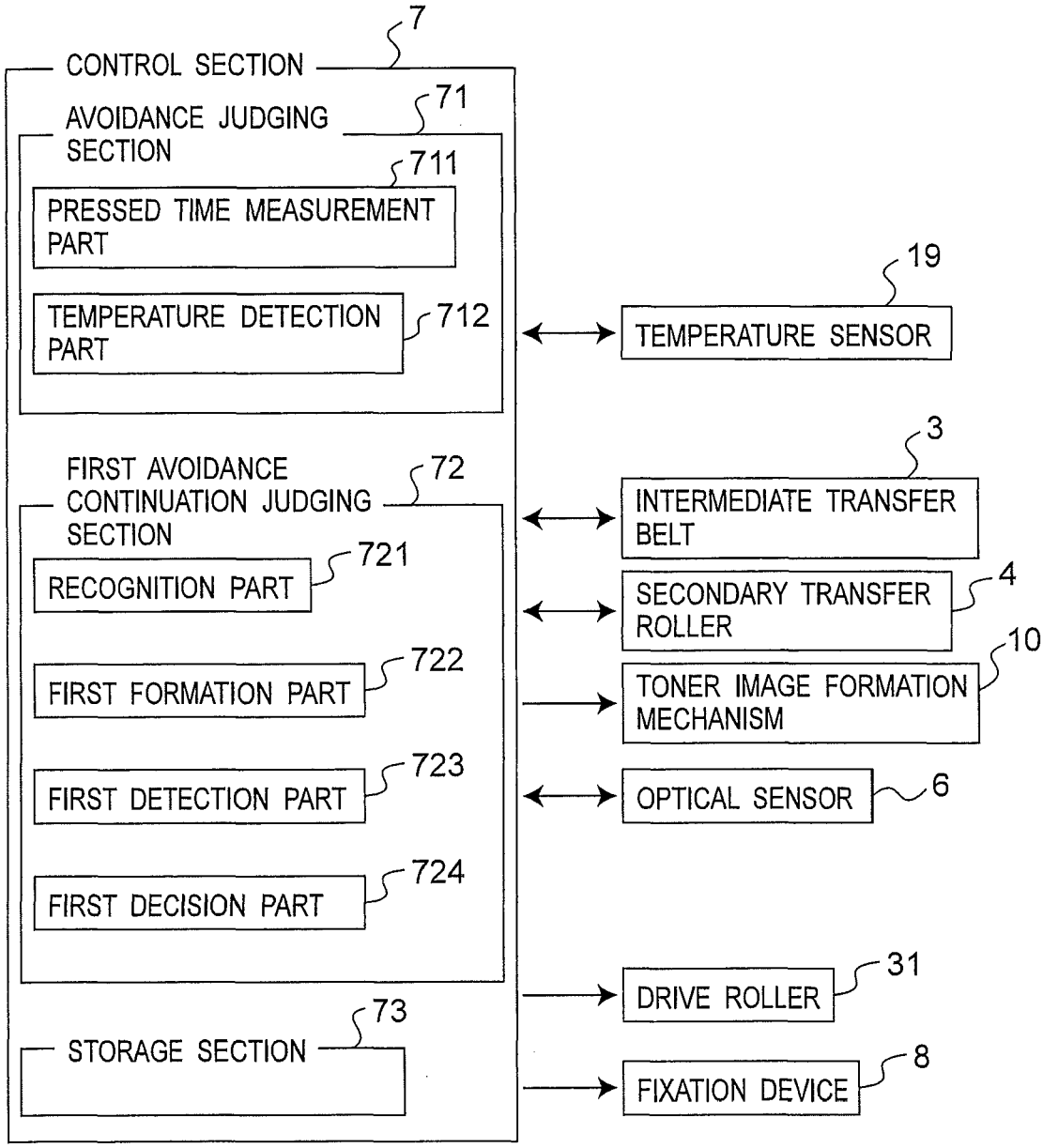
FIG. 3 is a conceptual diagram illustrating the configuration and control of a control section 7 of the image forming apparatus 1.

FIG. 3 is a conceptual diagram illustrating the configuration and control of the control section 7 of the image forming apparatus 1. In this image forming apparatus 1, the control section 7 includes: an avoidance judging section 71 for judging whether or not avoidance of a pressed region of the intermediate transfer belt 3 should be performed when a toner image for image formation is formed on the intermediate transfer belt 3 (image carrier); and a first avoidance continuation judging section 72 for judging the necessity for continuation of the avoidance by being operated when it is judged by the avoidance judging section 71 that the "avoidance should be performed".

The avoidance judging section 71 includes: a pressed time measurement part 711; and a temperature detection part 712. The pressed time measurement part 711 measures the time during which the secondary transfer roller 4 (transfer member) is pressed against the intermediate transfer belt 3 between the end of a previous image forming operation (hereinafter referred to as "JOB1") and the start of a present image forming operation (hereinafter referred to as "JOB2"). As illustrated in FIG. 1, a pressed region of the intermediate transfer belt 3, which is pressed against the secondary transfer roller 4 during this pressed time, will hereinafter be referred to as a "pressed region A", and a region adjacent to the pressed region A will hereinafter be referred to as an "adjacent region B". The temperature detection part 712 measures the temperature of inside of the image forming apparatus 1 by means of the temperature sensor 19.

More specifically, when a toner image for image formation is formed on the intermediate transfer belt 3 in JOB2 after the end of JOB1, the avoidance judging section 71 judges whether or not the pressed region A of the intermediate transfer belt 3 should be avoided based on: the pressed time measured by the pressed time measurement part 711; and the temperature detected by the temperature detection part 712.

The first avoidance continuation judging section 72 includes: a recognition part 721; a first formation part 722; a first detection part 723; and a first decision part 724. The recognition part 721 recognizes the position of the pressed region A. The first formation part 722 forms a detection toner image on the pressed region A and the adjacent region B by the toner image formation mechanism 10. The first detection part 723 detects a toner attachment amount of the detection toner image by the optical sensor 6. The first decision part 724 makes a comparison between the toner attachment amount of the pressed region A and that of the adjacent region B, thus deciding the necessity for continuation of the avoidance based on whether or not a difference therebetween falls within a given range.

Figure 4:
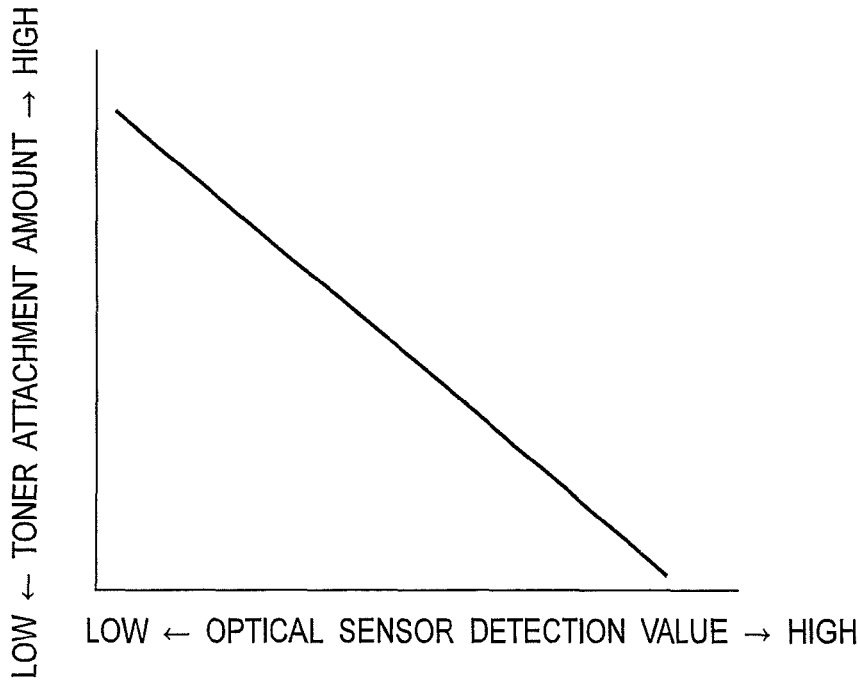
FIG. 4 is a conceptual graph illustrating a relationship between an optical sensor detection value and a toner attachment amount.
Figure 5:
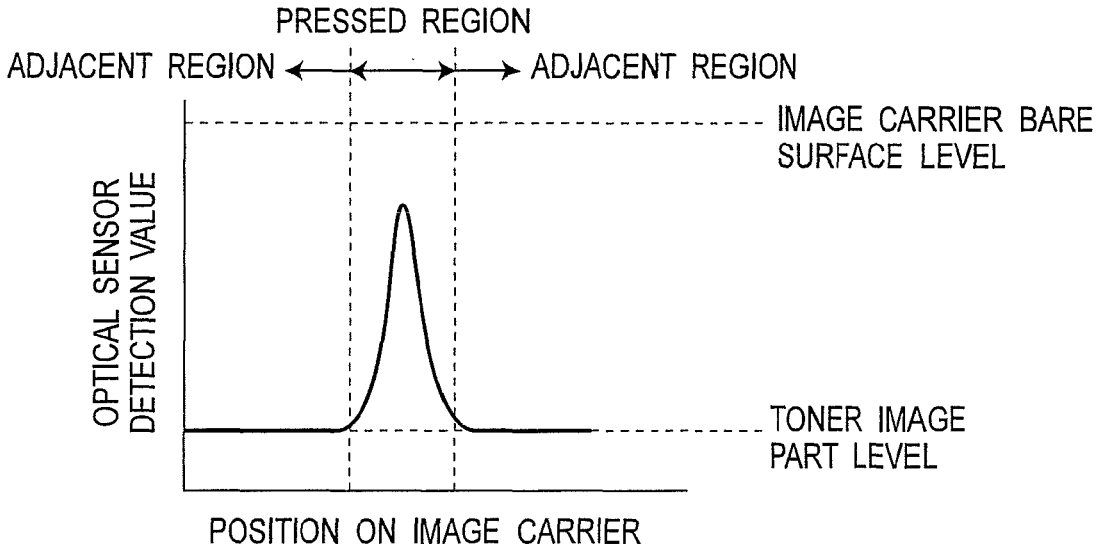
FIG. 5 is a conceptual graph illustrating optical sensor detection values in a pressed region A and an adjacent region B.
Figure 6:
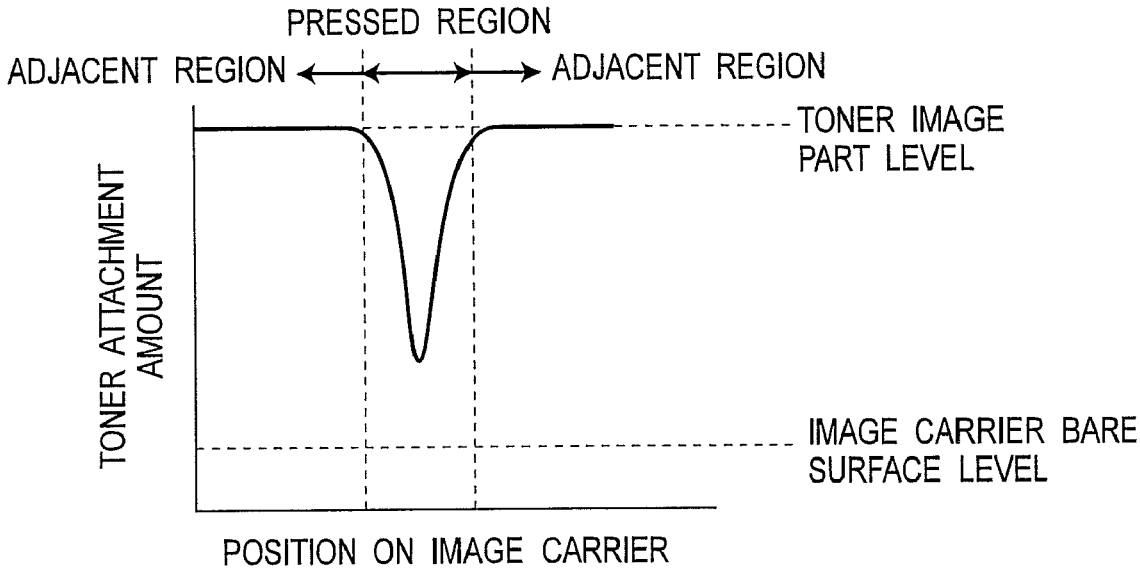
FIG. 6 is a conceptual graph illustrating toner attachment amounts in the pressed region A and the adjacent region B.

As the optical sensor 6, there is used a sensor exhibiting the following characteristics: the smaller the toner attachment amount, the higher the optical sensor detection value, whereas the larger the toner attachment amount, the lower the optical sensor detection value. FIG. 4 is a conceptual graph illustrating a relationship between an optical sensor detection value and a toner attachment amount, detected by the optical sensor 6. FIG. 5 is a conceptual graph illustrating optical sensor detection values in the pressed region A and the adjacent region B. FIG. 6 is a conceptual graph illustrating toner attachment amounts in the pressed region A and the adjacent region B. It should be noted that there may be used an optical sensor exhibiting the following characteristics: the larger the toner attachment amount, the higher the optical sensor detection value, whereas the smaller the toner attachment amount, the lower the optical sensor detection value.

The principles of detection of toner attachment amounts by the optical sensor 6 are as follows. The transfer property of the pressed region A on the intermediate transfer belt 3 is lower than that of the adjacent region B to which no contaminant is attached, and therefore, toner is not sufficiently transferred, resulting in a reduction in the toner attachment amount. Hence, upon detection of the toner image formed on the pressed region A and the adjacent region B by the optical sensor, there is obtained a detection result in which the pressed region A presents an upwardly convex waveform with respect to the waveform of the adjacent region B as illustrated in FIG. 5. Since the optical sensor detection value and the toner attachment amount have the relationship illustrated in FIG. 4, upon conversion of the optical sensor detection value into the toner attachment amount, the pressed region A presents a downwardly convex waveform with respect to the waveform of the adjacent region B as illustrated in FIG. 6. From the toner attachment amount at which the waveform illustrated in FIG. 6 is minimized, the degree of white spot of the toner image on the pressed region A can be determined.

Figure 7:
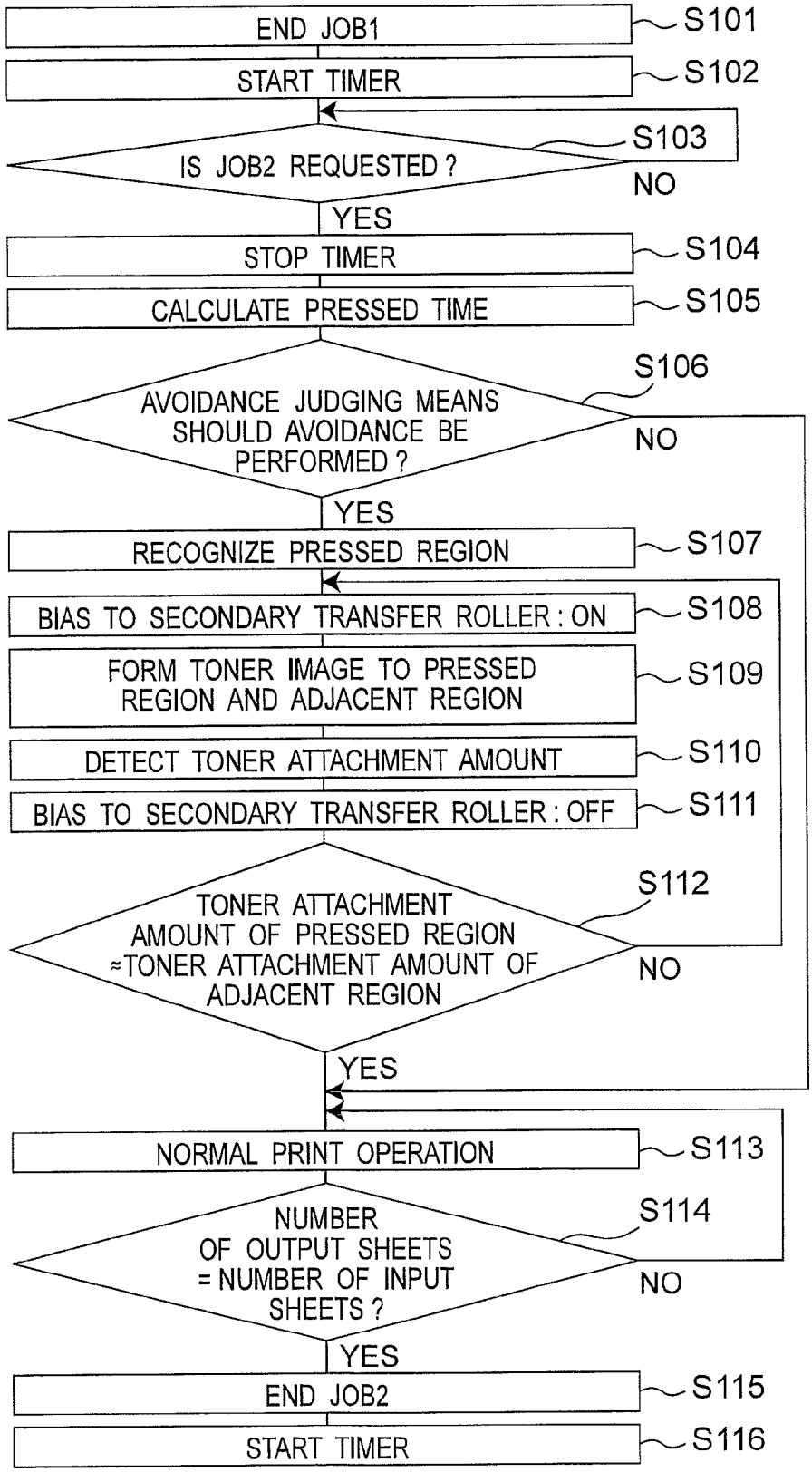
FIG. 7 is a flow chart illustrating a first embodiment of the present invention.

FIG. 7 illustrates a flow chart of process steps according to the present embodiment from the end of JOB1 to the end of JOB2.

After the end of JOB1 (Step (hereinafter denoted by "S") 101), the pressed time measurement part 711 starts measurement of pressed time during which the secondary transfer roller 4 is pressed against the intermediate transfer belt 3 (S102). This pressed time may be measured as deactivation time of the image forming apparatus 1.

Upon issuance of an instruction for starting JOB2 by a user (S103), the pressed time measurement part 711 ends the measurement of the pressed time (S104). Then, the pressed time is calculated (S105). Concurrently with the calculation of the pressed time, the temperature detection part 712 measures the temperature of inside of the image forming apparatus 1 using the temperature sensor 19.

Based on the pressed time measured by the pressed time measurement part 711 and the temperature (T) detected by the temperature detection part 712, the avoidance judging section 71 determines whether or not the avoidance of the pressed region should be performed (S106). In the present embodiment, it is judged by the avoidance judging section 71 that the "avoidance should be performed" when any of the following conditions (hereinafter referred to as "avoidance conditions") is satisfied: the pressed time is 0 hour or more when $T \geqq 30°$ C., the pressed time is 15 hours or more when $30° \text{ C.} \geqq T \geqq 10°$ C., and the pressed time is 72 hours or more when $T < 10°$ C. The foregoing avoidance conditions are decided in advance based on experiments and the like, and stored in a storage section 73 included in the control section 7.

When the pressed time and temperature do not satisfy any of the foregoing avoidance conditions, no white spot image occurs in the pressed region A; therefore, it is judged by the avoidance judging section 71 that the "avoidance should not be performed" (i.e., the answer is No in S106), a normal print operation is performed (S113), the number of sheets (input sheets) specified by the user is printed (S114), and then JOB2 ends (S115).

Upon judgment of the avoidance judging section 71 that the "avoidance should be performed" (i.e., when the answer is Yes in S106), an operation for forming an image while avoiding the pressed region A (which will hereinafter be called an "avoidance image forming operation") is performed, and the first avoidance continuation judging section 72 is operated concurrently with this operation in the image forming apparatus 1. While the avoidance image forming operation is performed, the image forming operation, in which the pressed region A and the adjacent region B are determined as non-image regions and other regions are used as image regions, is performed.

In the first avoidance continuation judging section 72, the recognition part 721 is first operated. The recognition part 721 recognizes the pressed region A (S107).

Next, a bias whose polarity is the same as that of toner is applied to the secondary transfer roller 4 (S108). The reason for this is that the contamination of the secondary transfer roller 4 by a detection toner image formed on the pressed region A and the adjacent region B, which will be described later, is suppressed. In the present embodiment, since the toner is charged with a negative polarity, a negative bias is applied to the secondary transfer roller 4.

Subsequently, the first formation part 722 forms the detection toner image on the pressed region A and the adjacent region B by the toner image formation mechanism 10 (S109). In this embodiment, when the image forming apparatus 1 is a color image forming apparatus, the first formation part 722 preferably forms a yellow toner image by the photosensitive body 11 (Y) in the toner image formation mechanism 10. On the other hand, when the image forming apparatus 1 is a monochrome image forming apparatus, only the photosensitive body 11 (Bk) is provided as the photosensitive body 11 in the toner image formation mechanism 10, and therefore, the first formation part 722 forms a black toner image by the photosensitive body 11 (Bk).

Next, the first detection part 723 detects the toner attachment amount of the toner image part by the optical sensor 6 (S110).

Then, after the detection toner image formed on the pressed region A and the adjacent region B has passed through the secondary transfer roller 4, the application of the negative bias to the secondary transfer roller 4 is cancelled (S111).

Subsequently, the first decision part 724 makes a comparison between the toner attachment amount of the pressed region A and that of the adjacent region B, and decides that there is the "necessity" for continuation of the avoidance until both of the toner attachment amounts become substantially equal in value (S112). Thus, the process steps of S108 to S112 will thereafter be repeated.

Then, when the toner attachment amount of the pressed region A and that of the adjacent region B have become substantially equal in value (S112), the first decision part 724 decides that there is "no necessity" for continuation of the avoidance. Thus, the operation of the first avoidance continuation judging section 72 ends, and then a normal print operation is performed (S113).

Upon printing of the number of sheets (input sheets) specified by the user (S114), JOB2 ends (S115).

Upon deactivation of the image forming apparatus 1, the pressed time measurement part 711 starts the measurement of the pressed time during which the secondary transfer roller 4 is pressed against the intermediate transfer belt 3 (S116).

The image forming apparatus 1 having the above-described configuration is capable of achieving the following effects.

A toner image is formed on the pressed region A between the secondary transfer roller 4 and the intermediate transfer belt 3, and on the adjacent region B, and the necessity for continuation of avoidance of image formation to the pressed region A is decided based on a detection result of the toner attachment amount of the toner image, thus making it possible to perform the minimum necessary avoidance. In other words, the necessary avoidance is performed with reliability, thus enabling the prevention of occurrence of a white spot image in the intermediate transfer belt 3, and allowing a favorable image to be outputted. Furthermore, the minimum avoidance is performed, thus enabling the prevention of problems such as reduction of productivity and prolongation of first print time.

If any of the foregoing avoidance conditions is not satisfied, the avoidance of the pressed region A does not have to be performed, and a normal print operation is directly performed, thus enabling a reduction in first print time.

Second Embodiment

Figure 8:
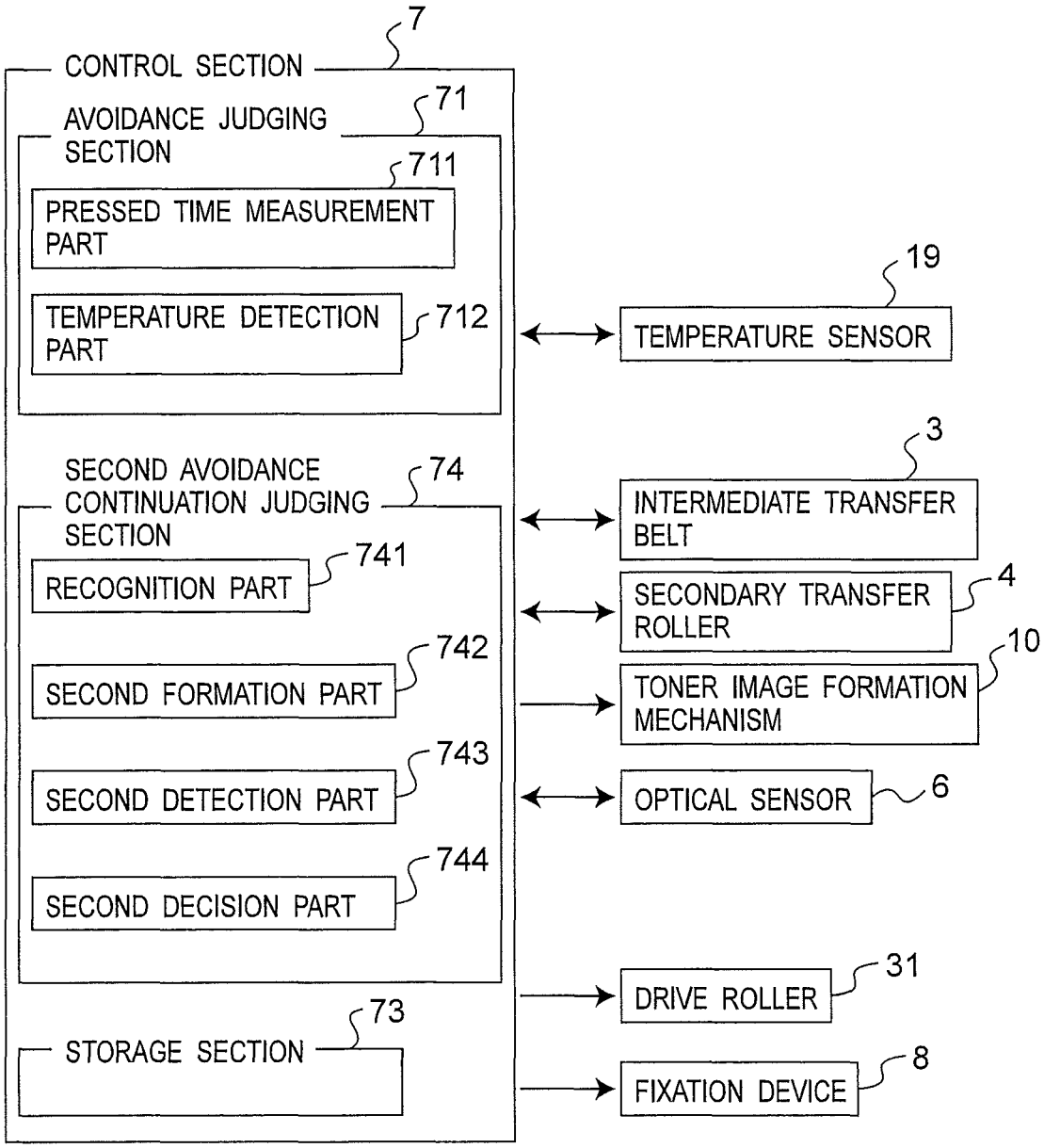
FIG. 8 is a conceptual diagram illustrating the configuration and control of a control section 7 of an image forming apparatus 1 according to a second embodiment of the present invention.

Hereinafter, a second embodiment will be described. An image forming apparatus 1 according to the second embodiment has a configuration substantially similar to that of the image forming apparatus 1 according to the first embodiment, and the second embodiment is similar to the first embodiment in that there is provided an avoidance judging section 71 for judging whether or not avoidance of a pressed region A between an intermediate transfer belt 3 and a secondary transfer roller 4 should be performed. FIG. 8 is a conceptual diagram illustrating the configuration and control of a control section 7 of the image forming apparatus 1. In the second embodiment, the control section 7 has a second avoidance continuation judging section 74 instead of the first avoidance continuation judging section 72. The second avoidance continuation judging section 74 includes: a recognition part 741; a second formation part 742; a second detection part 743; and a second decision part 744. The recognition part 741 recognizes the position of the pressed region A. The second formation part 742 forms a toner image onto the pressed region A of the intermediate transfer belt 3. The second detection part 743 detects the toner attachment amount of the intermediate transfer belt 3 by an optical sensor 6. The optical sensor 6 has a light emitting part and a light receiving part. The second decision part 744 decides the number of continuations of the avoidance based on the toner attachment amount of the pressed region A.

Figure 9:
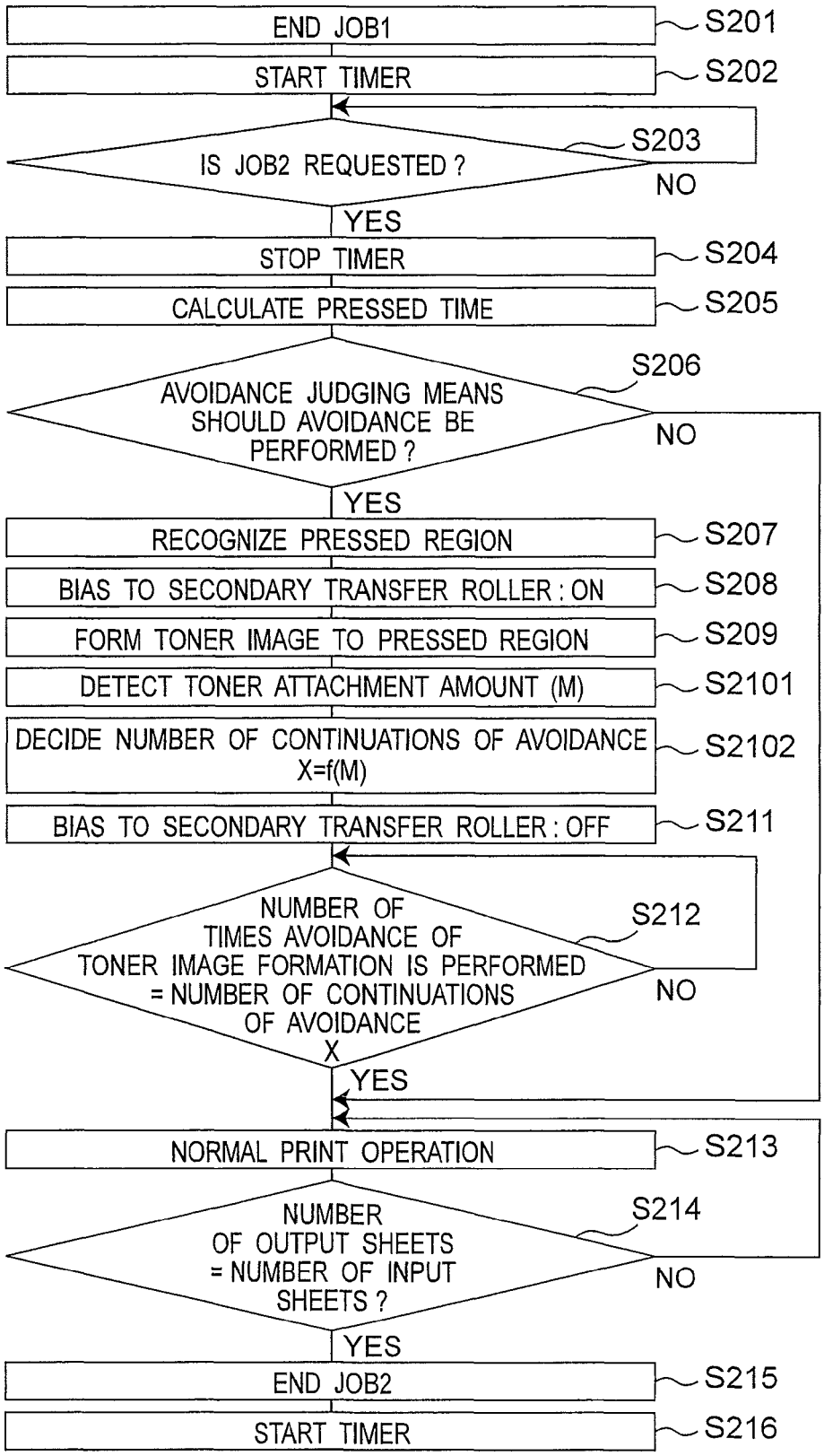
FIG. 9 is a flow chart illustrating the second embodiment of the present invention.

When it is judged by the avoidance judging section 71 that the "avoidance should be performed" in JOB2 after the end of JOB1, the second avoidance continuation judging section 74 performs the following control. Specifically, the pressed region A, which is located on the intermediate transfer belt 3 and pressed against the secondary transfer roller 4, is recognized by the recognition part 741, a detection toner image is formed onto the pressed region A by the second formation part 742, and the toner attachment amount of the formed toner image is detected by the second detection part 743. Then, based on the result of detection of the toner attachment amount, the number of continuations of the avoidance is decided by the second decision part 744. A method for deciding the number of continuations of the avoidance is performed as follows. Specifically, the detected toner attachment amount is compared with a value that is stored in advance in a storage section 73 in the control section 7 and indicative of "the number of continuations of the avoidance required for removal of contaminants attached to the pressed region with respect to the toner attachment amount", thereby deciding the number of continuations of the avoidance of the pressed region. In the case of forming the detection toner image with the goal of achieving a toner concentration of 1.0 g/m$^2$, for example, the number of continuations of the avoidance may be set at 15 times when the detected toner concentration is 75% or less of the goal, may be set at 5 times when the detected toner concentration is more than 75% and less than 90% of the goal, and may be set at zero when the detected toner concentration is more than 90% of the goal. It is to be noted that the conditions for setting the number of continuations of the avoidance are not limited to the above-described examples. FIG. 9 illustrates a flow chart of process steps according to the present embodiment from the end of JOB1 to the end of JOB2.

After the end of JOB1 (S201), the pressed time measurement part 711 starts measurement of pressed time during which the secondary transfer roller 4 is pressed against the intermediate transfer belt 3 (S202). This pressed time may be measured as deactivation time of the image forming apparatus 1.

Upon issuance of an instruction for starting JOB2 by a user (S203), the pressed time measurement part 711 ends the measurement of the pressed time (S204). Then, the pressed time is calculated (S205). Concurrently with the calculation of the pressed time, the temperature detection part 712 measures the temperature of inside of the image forming apparatus 1 using the temperature sensor 19.

Based on the pressed time measured by the pressed time measurement part 711 and the temperature (T) detected by the temperature detection part 712, the avoidance judging section 71 determines whether or not the avoidance of the pressed region should be performed (S206). In the present embodiment, it is judged by the avoidance judging section 71 that the "avoidance should be performed" when any of the following conditions (hereinafter referred to as "avoidance conditions") is satisfied: the pressed time is 0 hour or more when $T \geqq 30°$ C., the pressed time is 15 hours or more when $30°$ C.$\geqq T \geqq 10°$ C., and the pressed time is 72 hours or more when $T < 10°$ C. The foregoing avoidance conditions are decided in advance based on experiments and the like, and stored in the storage section 73 included in the control section 7.

When the pressed time and temperature do not satisfy any of the foregoing avoidance conditions, no white spot image occurs in the pressed region A; therefore, it is judged by the avoidance judging section 71 that the "avoidance should not be performed" (i.e., the answer is No in S206), a normal print operation is performed (S213), the number of sheets (input sheets) specified by the user is printed (S214), and then JOB2 ends (S215).

Upon judgment of the avoidance judging section 71 that the "avoidance should be performed" (i.e., when the answer is Yes in S206), an operation for forming an image while avoiding the pressed region A (which will hereinafter be called an "avoidance image forming operation") is performed, and the second avoidance continuation judging section 74 is operated concurrently with this operation in the image forming apparatus 1. While the avoidance image forming operation is performed, the image forming operation, in which the pressed region A is determined as a non-image region and other regions are used as image regions, is performed.

In the second avoidance continuation judging section 74, the recognition part 741 is first operated. The recognition part 741 recognizes the pressed region A (S207).

Next, a bias whose polarity is the same as that of toner is applied to the secondary transfer roller 4 (S208). The reason for this is that the contamination of the secondary transfer roller 4 by a detection toner image formed on the pressed region A, which will be described later, is suppressed. In the present embodiment, since the toner is charged with a negative polarity, a negative bias is applied to the secondary transfer roller 4.

Subsequently, the second formation part 742 forms the detection toner image on the pressed region A by the toner image formation mechanism 10 (S209). In this embodiment, when the image forming apparatus 1 is a color image forming apparatus, the second formation part 742 preferably forms a yellow toner image by the photosensitive body 11 (Y) in the toner image formation mechanism 10. On the other hand, when the image forming apparatus 1 is a monochrome image forming apparatus, only the photosensitive body 11 (Bk) is provided as the photosensitive body 11 in the toner image formation mechanism 10, and therefore, the second formation part 742 forms a black toner image by the photosensitive body 11 (Bk).

Next, the second detection part 743 detects the toner attachment amount of the toner image part by the optical sensor 6 (S2101).

Subsequently, the toner attachment amount of the pressed region A is compared with a value that is stored in advance in the storage section 73 in the control section 7 and indicative of "the number of continuations of the avoidance required for removal of contaminants attached to the pressed region with respect to the toner attachment amount", and thus the second decision part 744 decides the number of continuations of the avoidance of the pressed region (S2102).

Then, after the detection toner image formed on the pressed region A has passed through the secondary transfer roller 4, the application of the negative bias to the secondary transfer roller 4 is cancelled (S211).

Next, a pressed region avoidance operation is carried out for the decided number of continuations of the avoidance of the pressed region (S212).

Upon carrying out of the pressed region avoidance operation for the decided number of continuations of the avoidance of the pressed region, the operation of the second avoidance continuation judging section 74 ends, and then a normal print operation is performed (S213).

Upon printing of the number of sheets (input sheets) specified by the user (S214), JOB2 ends (S215).

Upon deactivation of the image forming apparatus 1, the pressed time measurement part 711 starts the measurement of the pressed time during which the secondary transfer roller 4 is pressed against the intermediate transfer belt 3 (S216).

The image forming apparatus 1 having the above-described configuration is capable of achieving the following effects.

Since the number of continuations of avoidance of toner image formation to the pressed region A is decided by the single detection toner image formation, the need for forming the detection toner image every time is eliminated. As a result, problems such as reduction of productivity and prolongation of first print time can be prevented while the occurrence of a white spot image in the intermediate transfer belt 3 is prevented, and in particular, it is possible to easily return to normal printing.

If any of the foregoing avoidance conditions is not satisfied, the avoidance of the pressed region A does not have to be performed, and a normal print operation is directly performed, thus enabling a reduction in first print time.

Third Embodiment

Hereinafter, a third embodiment will be described. The third embodiment is similar to the first embodiment except the configurations of the first detection part 723 and first decision part 724. In the third embodiment, toner attachment amounts of the pressed region A are detected by the first detection part 723 using a plurality of the optical sensors 6, and the first decision part 724 decides the necessity for continuation of avoidance of toner image formation to the pressed region A based on: the smallest one of the toner attachment amounts detected at plurality of positions in the pressed region A; and the toner attachment amount of the adjacent region B.

Figure 10:
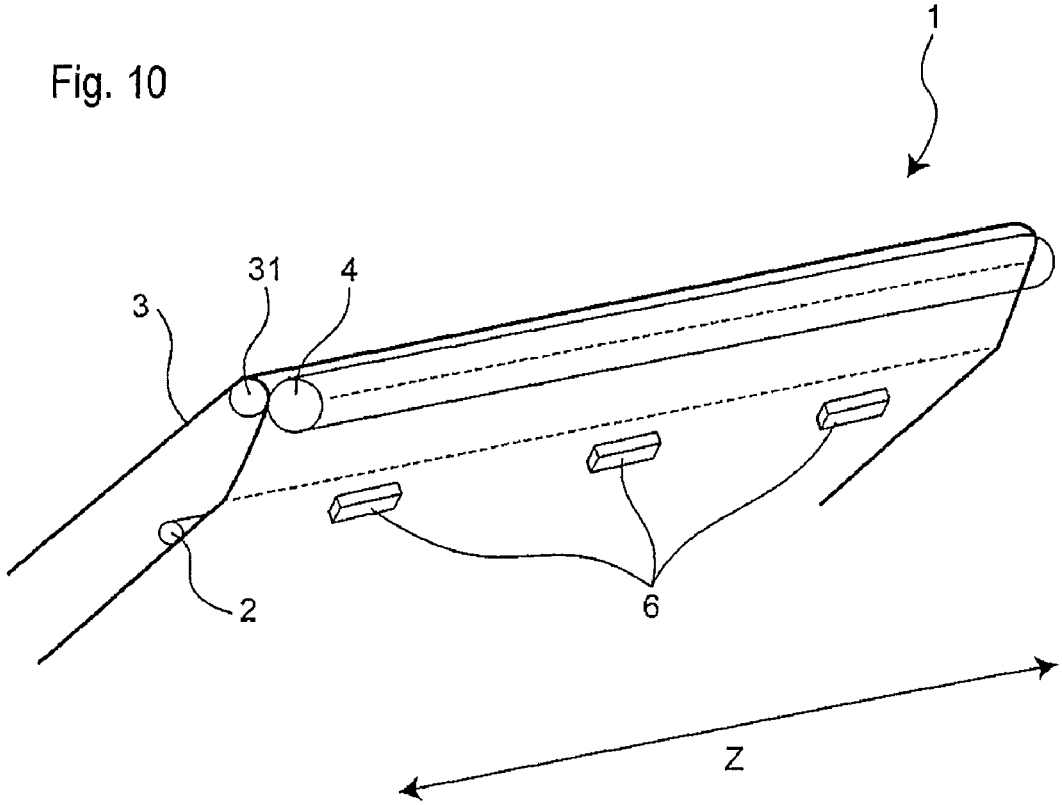
FIG. 10 is a partial perspective view illustrating an image forming apparatus 1 provided with a plurality of optical sensors 6.

FIG. 10 is a partial perspective view illustrating an image forming apparatus 1 provided with a plurality of the optical sensors 6. In the present embodiment, the N optical sensors 6 (the three optical sensors 6 in FIG. 10) are provided along the widthwise direction (Z direction) of the intermediate transfer belt 3 so as to be opposed to the intermediate transfer belt 3 within a range located downstream of a primary transfer part of the photosensitive body 11 (Bk) and upstream of a secondary transfer part of the secondary transfer roller 4. In the structure illustrated in FIG. 10, it is possible to detect the toner attachment amounts at three positions of the pressed region A, which are arranged in the widthwise direction (Z direction) of the intermediate transfer belt 3.

The optical sensors 6 each exhibit characteristics similar to those of the optical sensor 6 according to the first embodiment as follows: the smaller the toner attachment amount, the higher the optical sensor detection value, whereas the larger the toner attachment amount, the lower the optical sensor detection value. In the present embodiment, a detection toner image is formed on the pressed region A and the adjacent region B, and the toner attachment amounts of the toner image part in the widthwise direction of the intermediate transfer belt 3 are detected by the N optical sensors 6 arranged so as to be opposed to the intermediate transfer belt 3.

When the N optical sensors 6 are arranged in the widthwise direction of the intermediate transfer belt 3, detection values (toner attachment amounts: M) corresponding to the N optical sensors 6 are obtainable. The obtained N toner attachment amounts (M1 to MN) are compared with each other, and the smallest toner attachment amount (Mmin) is determined as a position at which a bleed-induced white spot is the largest among the toner attachment amounts detected along the widthwise direction of the intermediate transfer belt 3.

Although a plurality of the optical sensors 6 are arranged in the widthwise direction of the intermediate transfer belt 3 in the present embodiment, the optical sensors 6 may alternatively be arranged so as to be movable with respect to the widthwise direction of the intermediate transfer belt 3.

Figure 11:
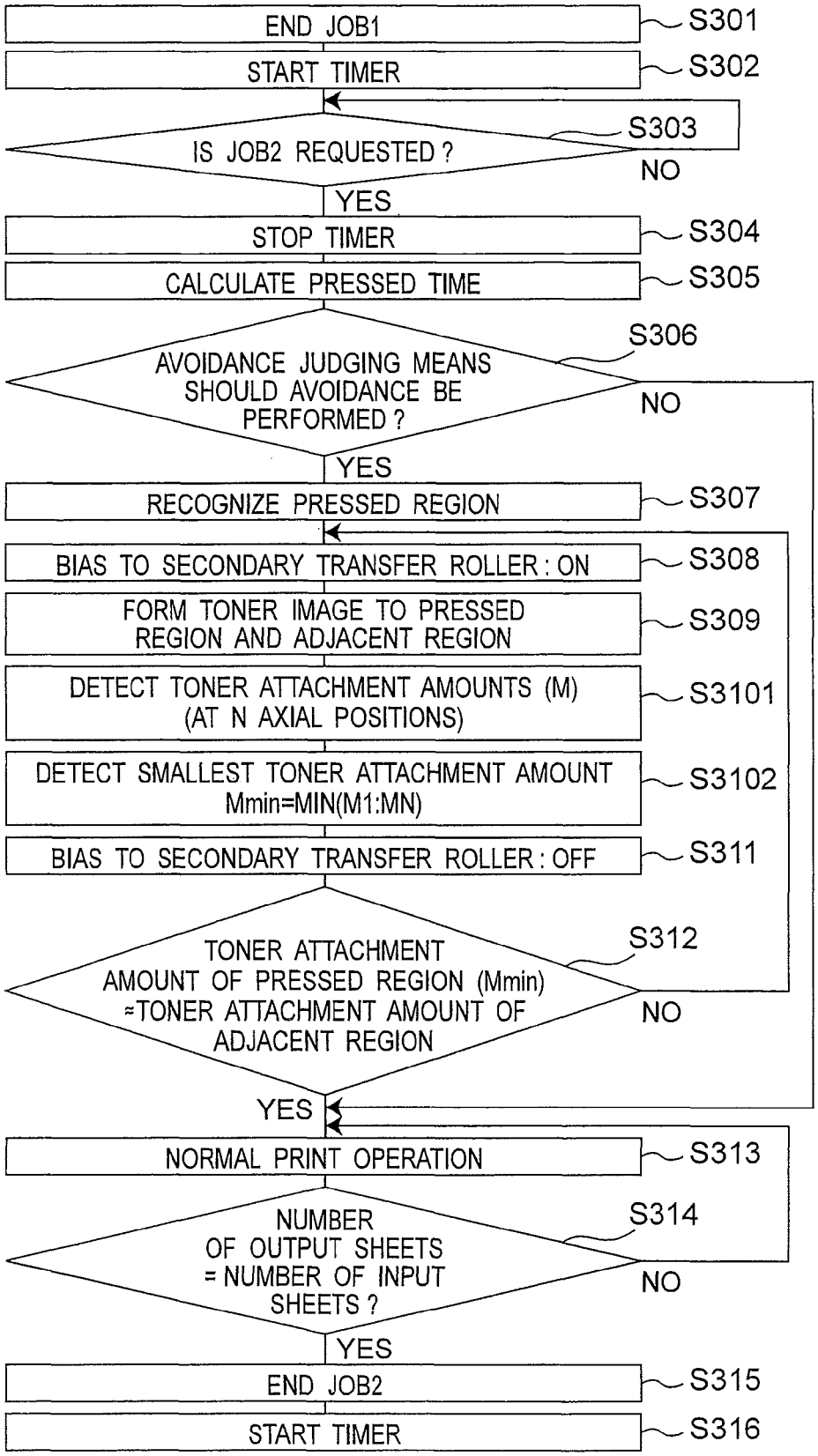
FIG. 11 is a flow chart illustrating a third embodiment of the present invention.

When it is judged by the avoidance judging section 71 that the "avoidance should be performed" in JOB2 after the end of JOB1, the first avoidance continuation judging section 72 performs the following control. Specifically, the pressed region A, which is located on the intermediate transfer belt 3 and pressed against the secondary transfer roller 4, is recognized by the recognition part 721, a detection toner image is formed onto the pressed region A and the adjacent region B by the first formation part 722, and the toner attachment amounts of the pressed region A are detected by the first detection part 723 across the widthwise direction of the intermediate transfer belt 3. Then, based on the smallest toner attachment amount (Mmin), the first decision part 724 decides the necessity for continuation of the avoidance of toner image formation to the pressed region A. FIG. 11 illustrates a flow chart of process steps according to the present embodiment from the end of JOB1 to the end of JOB2.

After the end of JOB1 (S301), the pressed time measurement part 711 starts measurement of pressed time during which the secondary transfer roller 4 is pressed against the intermediate transfer belt 3 (S302). This pressed time may be measured as deactivation time of the image forming apparatus 1.

Upon issuance of an instruction for starting JOB2 by a user (S303), the pressed time measurement part 711 ends the measurement of the pressed time (S304). Then, the pressed time is calculated (S305). Concurrently with the calculation of the pressed time, the temperature detection part 712 measures the temperature of inside of the image forming apparatus 1 using the temperature sensor 19.

Based on the pressed time measured by the pressed time measurement part 711 and the temperature (T) detected by the temperature detection part 712, the avoidance judging section 71 determines whether or not the avoidance of the pressed region should be performed (S306). In the present embodiment, it is judged by the avoidance judging section 71 that the "avoidance should be performed" when any of the following conditions (hereinafter referred to as "avoidance conditions") is satisfied: the pressed time is 0 hour or more when $T \geqq 30°$ C., the pressed time is 15 hours or more when $30° \text{ C.} \geqq T \geqq 10°$ C., and the pressed time is 72 hours or more when $T < 10°$ C. The foregoing avoidance conditions are decided in advance based on experiments and the like, and stored in the storage section 73 included in the control section 7.

When the pressed time and temperature do not satisfy any of the foregoing avoidance conditions, no white spot image occurs in the pressed region A; therefore, it is judged by the avoidance judging section 71 that the "avoidance should not be performed" (i.e., the answer is No in S306), a normal print operation is performed (S313), the number of sheets (input sheets) specified by the user is printed (S314), and then JOB2 ends (S315).

Upon judgment of the avoidance judging section 71 that the "avoidance should be performed" (i.e., when the answer is Yes in S306), an operation for forming an image while avoiding the pressed region A (which will hereinafter be called an "avoidance image forming operation") is performed, and the first avoidance continuation judging section 72 is operated concurrently with this operation in the image forming apparatus 1. While the avoidance image forming operation is performed, the image forming operation, in which the pressed region A and the adjacent region B are determined as non-image regions and other regions are used as image regions, is performed.

In the first avoidance continuation judging section 72, the recognition part 721 is first operated. The recognition part 721 recognizes the pressed region A (S307).

Next, a bias whose polarity is the same as that of toner is applied to the secondary transfer roller 4 (S308). The reason for this is that the contamination of the secondary transfer roller 4 by a detection toner image formed on the pressed region A and the adjacent region B, which will be described later, is suppressed. In the present embodiment, since the toner is charged with a negative polarity, a negative bias is applied to the secondary transfer roller 4.

Subsequently, the first formation part 722 forms the detection toner image on the pressed region A and the adjacent region B by the toner image formation mechanism 10 (S309). In this embodiment, when the image forming apparatus 1 is a color image forming apparatus, the first formation part 722 preferably forms a yellow toner image by the photosensitive body 11 (Y) in the toner image formation mechanism 10. On the other hand, when the image forming apparatus 1 is a monochrome image forming apparatus, only the photosensitive body 11 (Bk) is provided as the photosensitive body 11 in the toner image formation mechanism 10, and therefore, the first formation part 722 forms a black toner image by the photosensitive body 11 (Bk).

Next, using the N optical sensors 6 arranged in the widthwise direction of the intermediate transfer belt 3, the first detection part 723 detects: the toner attachment amounts of the pressed region A along the widthwise direction of the intermediate transfer belt 3; and the toner attachment amount of the adjacent region B (S3101).

Subsequently, the first decision part 724 makes comparisons on the N detection results of toner attachment amounts of the pressed region A, and extracts the smallest toner attachment amount (Mmin) (S3102).

Then, after the detection toner image formed on the pressed region A and the adjacent region B has passed through the secondary transfer roller 4, the application of the negative bias to the secondary transfer roller 4 is cancelled (S311).

Subsequently, the first decision part 724 makes a comparison between the smallest toner attachment amount (Mmin) of the pressed region A and the toner attachment amount of the adjacent region B, and decides that there is the "necessity" for continuation of the avoidance until both of the toner attachment amounts become substantially equal in value (S312). Thus, the process steps of S308 to S312 will thereafter be repeated.

Then, when the smallest toner attachment amount (Mmin) of the pressed region A and the toner attachment amount of the adjacent region B have become substantially equal in value (S312), the first decision part 724 decides that there is "no necessity" for continuation of the avoidance. Thus, the operation of the first avoidance continuation judging section 72 ends, and then a normal print operation is performed (S313).

Upon printing of the number of sheets (input sheets) specified by the user (S314), JOB2 ends (S315).

Upon deactivation of the image forming apparatus 1, the pressed time measurement part 711 starts the measurement of the pressed time during which the secondary transfer roller 4 is pressed against the intermediate transfer belt 3 (S316).

In addition to the effects of the first embodiment, the image forming apparatus 1 having the above-described configuration is capable of achieving the following effects.

The toner attachment amounts are detected at a plurality of positions arranged in the widthwise direction of the intermediate transfer belt 3, and the necessity for continuation of the avoidance of toner image formation to the pressed region A is decided based on the detection result of the smallest toner attachment amount, thus making it possible to more reliably prevent the occurrence of a white spot image in the intermediate transfer belt 3.

Fourth Embodiment

Hereinafter, a fourth embodiment will be described. The fourth embodiment is similar to the second embodiment except the configurations of the second detection part 743 and the second decision part 744. In the fourth embodiment, toner attachment amounts of the pressed region A are detected by the second detection part 743 using a plurality of the optical sensors 6, and based on the smallest one of the toner attachment amounts detected at a plurality of positions in the pressed region A, the second decision part 744 decides the number of continuations of avoidance of toner image formation to the pressed region A.

In the present embodiment, the N optical sensors 6 (the three optical sensors 6 in FIG. 10) are provided along the widthwise direction (Z direction) of the intermediate transfer belt 3 so as to be opposed to the intermediate transfer belt 3 within a range located downstream of a primary transfer part of the photosensitive body 11 (Bk) and upstream of a secondary transfer part of the secondary transfer roller 4. In the structure illustrated in FIG. 10, it is possible to detect the toner attachment amounts at three positions of the pressed region A, which are arranged in the widthwise direction (Z direction) of the intermediate transfer belt 3.

The optical sensors 6 each exhibit characteristics similar to those of the optical sensor 6 according to the first embodiment as follows: the smaller the toner attachment amount, the higher the optical sensor detection value, whereas the larger the toner attachment amount, the lower the optical sensor detection value. In the present embodiment, a detection toner image is formed on the pressed region A, and the toner attachment amounts of the toner image part in the widthwise direction of the intermediate transfer belt 3 are detected by the N optical sensors 6 arranged so as to be opposed to the intermediate transfer belt 3.

When the N optical sensors 6 are arranged in the widthwise direction of the intermediate transfer belt 3, detection values (toner attachment amounts: M) corresponding to the N optical sensors 6 are obtainable. The obtained N toner attachment amounts (M1 to MN) are compared with each other, and the smallest toner attachment amount (Mmin) is determined as a position at which a bleed-induced white spot is the largest among the toner attachment amounts detected along the widthwise direction of the intermediate transfer belt 3.

Although a plurality of the optical sensors 6 are arranged in the widthwise direction of the intermediate transfer belt 3 in the present embodiment, the optical sensors 6 may alternatively be arranged so as to be movable with respect to the widthwise direction of the intermediate transfer belt 3.

Figure 12:
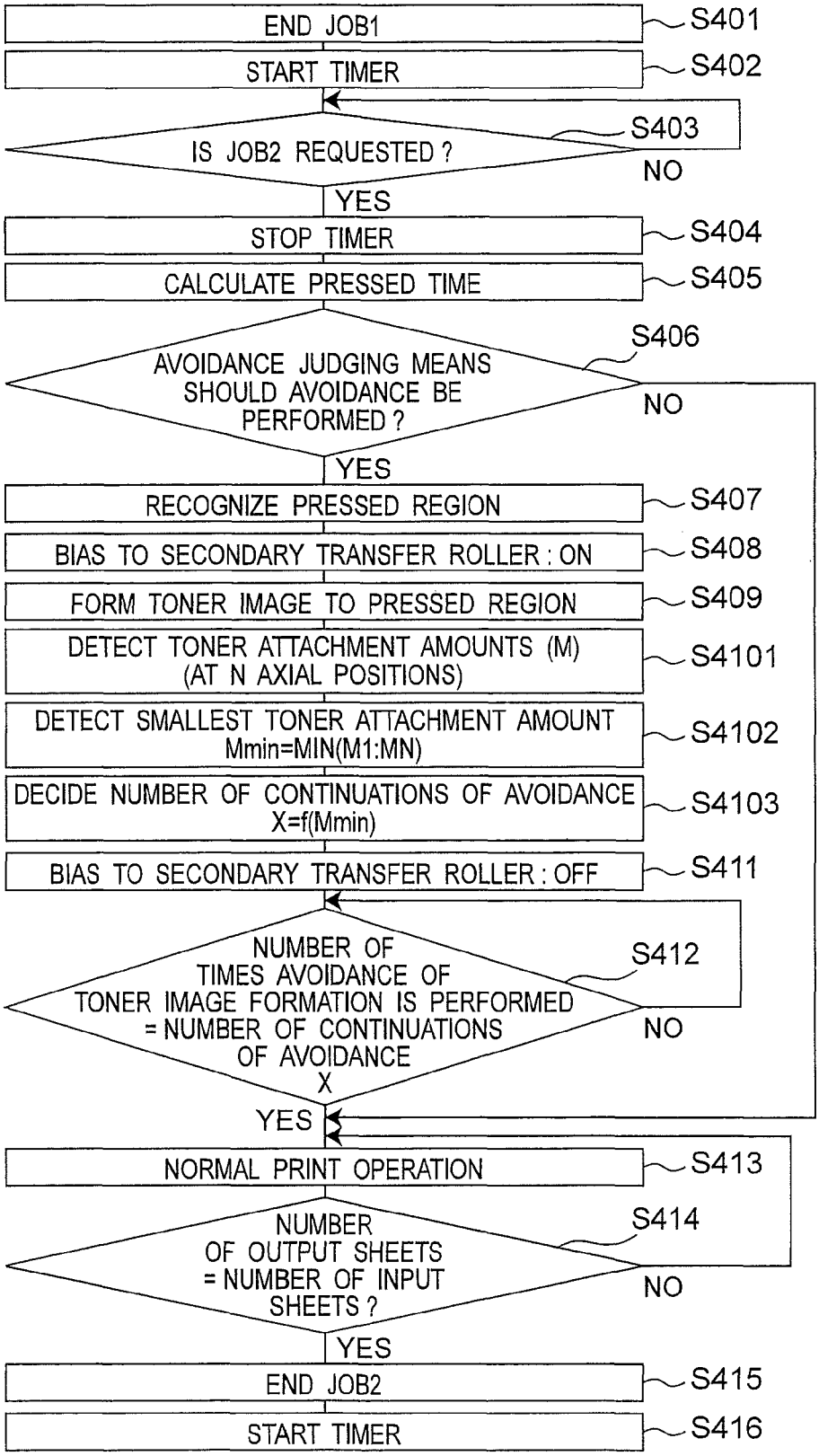
FIG. 12 is a flow chart illustrating a fourth embodiment of the present invention.

When it is judged by the avoidance judging section 71 that the "avoidance should be performed" in JOB2 after the end of JOB1, the second avoidance continuation judging section 74 performs the following control. Specifically, the pressed region A, which is located on the intermediate transfer belt 3 and pressed against the secondary transfer roller 4, is recognized by the recognition part 741, a detection toner image is formed onto the pressed region A by the second formation part 742, and the toner attachment amounts of the pressed region A are detected by the second detection part 743 across the widthwise direction of the intermediate transfer belt 3. Then, based on the smallest toner attachment amount (Mmin), the number of continuations of the avoidance is decided by the second decision part 744. A method for deciding the number of continuations of the avoidance is performed as follows. Specifically, the smallest toner attachment amount (Mmin) is compared with a value that is stored in advance in the storage section 73 in the control section 7 and indicative of "the number of continuations of the avoidance required for removal of contaminants attached to the pressed region with respect to the toner attachment amount", thereby deciding the number of continuations of the avoidance of the pressed region. In the case of forming the detection toner image with the goal of achieving a toner concentration of 1.0 $g/m^2$, for example, the number of continuations of the avoidance may be set at 15 times when the detected toner concentration is 75% or less of the goal, may be set at 5 times when the detected toner concentration is more than 75% and less than 90% of the goal, and may be set at zero when the detected toner concentration is more than 90% of the goal. It is to be noted that the conditions for setting the number of continuations of the avoidance are not limited to the above-described examples. FIG. 12 illustrates a flow chart of process steps according to the present embodiment from the end of JOB1 to the end of JOB2.

After the end of JOB1 (S401), the pressed time measurement part 711 starts measurement of pressed time during which the secondary transfer roller 4 is pressed against the intermediate transfer belt 3 (S402). This pressed time may be measured as deactivation time of the image forming apparatus 1.

Upon issuance of an instruction for starting JOB2 by a user (S403), the pressed time measurement part 711 ends the measurement of the pressed time (S404). Then, the pressed time is calculated (S405). Concurrently with the calculation of the pressed time, the temperature detection part 712 measures the temperature of inside of the image forming apparatus 1 using the temperature sensor 19.

Based on the pressed time measured by the pressed time measurement part 711 and the temperature (T) detected by the temperature detection part 712, the avoidance judging section 71 determines whether or not the avoidance of the pressed region should be performed (S406). In the present embodiment, it is judged by the avoidance judging section 71 that the "avoidance should be performed" when any of the following conditions (hereinafter referred to as "avoidance conditions") is satisfied: the pressed time is 0 hour or more when T≧30° C., the pressed time is 15 hours or more when 30° C.≧T≧10° C., and the pressed time is 72 hours or more when T<10° C. The foregoing avoidance conditions are decided in advance based on experiments and the like, and stored in the storage section 73 included in the control section 7.

When the pressed time and temperature do not satisfy any of the foregoing avoidance conditions, no white spot image occurs in the pressed region A; therefore, it is judged by the avoidance judging section 71 that the "avoidance should not be performed" (i.e., the answer is No in S406), a normal print operation is performed (S413), the number of sheets (input sheets) specified by the user is printed (S414), and then JOB2 ends (S415).

Upon judgment of the avoidance judging section 71 that the "avoidance should be performed" (i.e., when the answer is Yes in S406), an operation for forming an image while avoiding the pressed region A (which will hereinafter be called an "avoidance image forming operation") is performed, and the second avoidance continuation judging section 74 is operated concurrently with this operation in the image forming apparatus 1. While the avoidance image forming operation is performed, the image forming operation, in which the pressed region A is determined as a non-image region and other regions are used as image regions, is performed.

In the second avoidance continuation judging section 74, the recognition part 741 is first operated. The recognition part 741 recognizes the pressed region A (S407).

Next, a bias whose polarity is the same as that of toner is applied to the secondary transfer roller 4 (S408). The reason for this is that the contamination of the secondary transfer roller 4 by a detection toner image formed on the pressed region A, which will be described later, is suppressed. In the present embodiment, since the toner is charged with a negative polarity, a negative bias is applied to the secondary transfer roller 4.

Subsequently, the second formation part 742 forms the detection toner image on the pressed region A by the toner image formation mechanism 10 (S409). In this embodiment, when the image forming apparatus 1 is a color image forming apparatus, the second formation part 742 preferably forms a yellow toner image by the photosensitive body 11 (Y) in the toner image formation mechanism 10. On the other hand, when the image forming apparatus 1 is a monochrome image forming apparatus, only the photosensitive body 11 (Bk) is provided as the photosensitive body 11 in the toner image formation mechanism 10, and therefore, the second formation part 742 forms a black toner image by the photosensitive body 11 (Bk).

Next, using the N optical sensors 6 arranged in the widthwise direction of the intermediate transfer belt 3, the second detection part 743 detects the toner attachment amounts of the pressed region A along the widthwise direction of the intermediate transfer belt 3 (S4101).

Subsequently, the second decision part 744 makes comparisons on the N detection results of toner attachment amounts of the pressed region A, and extracts the smallest toner attachment amount (Mmin) (S4102).

Next, the smallest toner attachment amount (Mmin) in the pressed region A is compared with a value that is stored in advance in the storage section 73 in the control section 7 and indicative of "the number of continuations of the avoidance required for removal of contaminants attached to the pressed region with respect to the toner attachment amount", and thus the second decision part 744 decides the number of continuations of the avoidance of the pressed region A (S4103).

Then, after the detection toner image formed on the pressed region A has passed through the secondary transfer roller 4, the application of the negative bias to the secondary transfer roller 4 is cancelled (S411).

Subsequently, a pressed region avoidance operation is carried out for the decided number of continuations of the avoidance of the pressed region (S412).

Upon carrying out of the pressed region avoidance operation for the decided number of continuations of the avoidance of the pressed region, the operation of the second avoidance continuation judging section 74 ends, and then a normal print operation is performed (S413).

Upon printing of the number of sheets (input sheets) specified by the user (S414), JOB2 ends (S415).

Upon deactivation of the image forming apparatus 1, the pressed time measurement part 711 starts the measurement of the pressed time during which the secondary transfer roller 4 is pressed against the intermediate transfer belt 3 (S416).

In addition to the effects of the second embodiment, the image forming apparatus 1 having the above-described configuration is capable of achieving the following effects.

The toner attachment amounts are detected at a plurality of positions arranged in the widthwise direction of the intermediate transfer belt 3, and the number of continuations of the avoidance of toner image formation to the pressed region A is decided based on the detection result of the smallest toner attachment amount, thus making it possible to more reliably prevent the occurrence of a white spot image in the intermediate transfer belt 3.

Other Embodiments

The foregoing first to fourth embodiments are preferably implemented as follows.

As the toner color of a detection toner image formed on the pressed region A and the adjacent region B, yellow is preferably used in a color mode. However, magenta, cyan or black may alternatively be used. On the other hand, black is used in a monochrome mode.

Examples of recognition means of the recognition parts 721 and 741 for recognizing the pressed region A include means for recognizing the pressed region A as follows: a home position is provided on the intermediate transfer belt 3, the intermediate transfer belt 3 and the secondary transfer roller 4 are always stopped at the home position, and this home position is recognized, thereby recognizing the pressed region A. Examples of the recognition means further include means for measuring time elapsed since the start of operation of the intermediate transfer belt 3, thereby recognizing the position of the pressed region A from the peripheral length and peripheral velocity of the intermediate transfer belt 3.

However, the recognition means for recognizing the pressed region A are not limited to the above-described means.

The value of a bias to be applied to the secondary transfer roller 4 is preferably in the range of −200V to −1000V. However, the value of a bias to be applied is not limited to the above-mentioned range, but may be appropriately set in accordance with the type of toner (including toner color), the type of the image carrier, the type of the transfer member or a combination thereof.

The avoidance judging section 71 judges whether or not the avoidance of the pressed region should be performed in consideration of the following conditions: the pressed time is 0 hour when T≧30° C., the pressed time is 15 hours when 30° C.≧T≧10° C., and the pressed time is 72 hours when T<10° C. However, the conditions for judging the necessity for the avoidance of the pressed region are not limited the foregoing conditions, but may be appropriately set in accordance with a factor such as a material for the transfer member or a pressing force exerted between the transfer member and the image carrier.

The intermediate transfer belt 3 (image carrier) preferably has a surface resistivity in the range of $10^6$ to $10^{12}$ Ω/square. For example, the intermediate transfer belt 3 (image carrier) is provided using a base of a resin material such as polycarbonate, polyimide, polyphenylene sulfide, polyamideimide, polyvinylidene fluoride or tetrafluoroethylene-ethylene copolymer, in which a conductive filler such as carbon is dispersed or an ionic conductive material is contained. The thickness of the intermediate transfer belt 3 is preferably about 50 to 200 μm. Further, the intermediate transfer belt 3 (image carrier) may be one in which the above-described base is provided with a surface of an inorganic oxide or the like, or may be a photosensitive belt (drum) in which a photosensitive layer is provided on a surface of the above-described base or metal base. Furthermore, the intermediate transfer belt 3 (image carrier) is in the form of a belt in the foregoing embodiments, but may alternatively be in the form of a drum, in the form of a roller, etc.

Moreover, the secondary transfer roller 4 (transfer member) preferably has a surface resistivity in the range of $10^6$ to $10^{10}$ Ω/square. For example, the secondary transfer roller 4 (transfer member) is provided using a roller such as a sponge roller in which an elastic layer having an intermediate resistivity, such as EPDM, silicon, NBR or urethane, is formed in a foaming manner in a core of a metal material, or a solid rubber roller in which such an elastic layer is formed in an unfoamed manner in the core. The form of the secondary transfer roller 4 is not limited to a roller form, but the secondary transfer roller 4 may alternatively be in the form of a drum, in the form of an endless belt, in the form of a blade, etc.

It should be noted that the image forming apparatus 1 may be a monochrome/color copier, a printer, a FAX, a multifunction device thereof, etc. Furthermore, the various setting conditions described above may be changed in accordance with the apparatus when deemed appropriate.

Thus, according to the present invention, the following effects can be achieved.

According to the first embodiment and the third embodiment, the necessity for continuation of the avoidance is decided based on a difference between the toner attachment amount of the pressed region A and that of the adjacent region B, and therefore, the minimum necessary avoidance can be performed. In other words, since the necessary avoidance can be performed with reliability, the occurrence of a white spot image in the image carrier can be prevented, and a favorable image can be outputted. Furthermore, since the minimum avoidance can be performed, problems such as reduction of productivity and prolongation of first print time can be prevented.

According to the second embodiment and fourth embodiment, the number of continuations of the avoidance of image forming operation on the pressed region A is decided based on a result of detection of the toner attachment amount of the pressed region A. As a result, since the necessary avoidance is performed with reliability, the occurrence of a white spot image in the image carrier can be prevented, and a favorable image can be outputted. Furthermore, since the number of continuations of the avoidance of image forming operation is decided by the single detection toner image formation, problems such as reduction of productivity and prolongation of first print time can be prevented, and in particular, it is possible to easily return to normal printing.

According to the third embodiment, the first detection part 723 detects the toner attachment amounts at a plurality of positions of the pressed region A, which are arranged in the widthwise direction of the image carrier, and the first decision part 724 calculates a difference between the smallest one of the toner attachment amounts detected at the plurality of positions arranged in the widthwise direction, and the toner attachment amount of the adjacent region B of the pressed region A. Accordingly, since a judgment is made based on the smallest one of the toner attachment amounts detected at the plurality of positions, the occurrence of a white spot image in the image carrier can be prevented with more reliability.

According to the fourth embodiment, the second detection part 743 detects toner attachment amounts at a plurality of positions of the pressed region A, which are arranged in the widthwise direction of the image carrier, and the second decision part 744 decides the number of continuations of the avoidance based on the smallest one of the toner attachment amounts detected at the plurality of positions arranged in the widthwise direction. Accordingly, since a judgment is made based on the smallest one of the toner attachment amounts detected at the plurality of positions, the occurrence of a white spot image in the image carrier can be prevented with more reliability.

The avoidance judging section 71 includes: the pressed time measurement part 711 for measuring the time during which the transfer member is pressed against the image carrier between the end of a previous image forming operation and the start of a present image forming operation; and the temperature detection part 712 for detecting the temperature of inside of the image forming apparatus 1. Thus, a judgment on whether or not the avoidance should be performed is made based on the pressed time obtained by the pressed time measurement part 711 and the temperature obtained by the temperature detection part 712. Accordingly, the avoidance of the pressed region A may be unnecessary depending on the pressed time and temperature state, and in this case, an operation for avoiding the pressed region A is not performed, thus enabling a reduction in first print time.

The detection device is the optical sensor 6 having a light emitting part and a light receiving part. Accordingly, the detection device can be simply configured.

In short, according to the present invention, problems such as reduction of productivity and prolongation of first print time can be prevented, and the occurrence of a white spot image in the image carrier can be prevented.

Various modifications and changes may be made without departing from the spirit and scope of the present invention described in the claims.

What is claimed is:

1. An image forming apparatus comprising:

an image carrier;

a toner image formation mechanism for forming a toner image on the image carrier;

a transfer member, provided at a position at which the transfer member can be pressed against the image carrier, for transferring the toner image, formed on the image carrier, onto a transferred material;

a detection device for detecting a toner attachment amount of the toner image formed on the image carrier; and a control section, wherein the control section comprises:

an avoidance judging section for judging whether or not avoidance of a pressed region should be performed when a toner image for image formation is formed on the image carrier, the pressed region serving as a region located on the image carrier and being pressed against the transfer member from the end of a previous image forming operation to the start of a present image forming operation; and a first avoidance continuation judging section for judging the necessity for continuation of the avoidance by being operated when it is judged by the avoidance judging section that the "avoidance should be performed", and wherein the first avoidance continuation judging section comprises:

a recognition part for recognizing the position of the pressed region;

a first formation part for forming a detection toner image on the pressed region and an adjacent region of the pressed region by the toner image formation mechanism;

a first detection part for detecting, by the detection device, a toner attachment amount of the detection toner image formed on the pressed region and a toner attachment amount of the detection toner image formed on the adjacent region of the pressed region; and a first decision part for calculating a difference between both of the toner attachment amounts, thus deciding the necessity for continuation of the avoidance based on whether or not this difference falls within a given range.

2. The image forming apparatus according to claim 1, wherein the first detection part detects toner attachment amounts of the pressed region at a plurality of positions arranged in a widthwise direction of the image carrier, and wherein the first decision part calculates a difference between the smallest one of the toner attachment amounts detected at the plurality of positions arranged in the widthwise direction, and the toner attachment amount of the adjacent region of the pressed region.

3. The image forming apparatus according to claim 1, wherein the avoidance judging section comprises:

a pressed time measurement part for measuring time during which the transfer member is pressed against the image carrier between the end of the previous image forming operation and the start of the present image forming operation; and a temperature detection part for detecting a temperature of inside of the image forming apparatus, and wherein a judgment on whether or not the avoidance should be performed is made based on the pressed time obtained by the pressed time measurement part and the temperature obtained by the temperature detection part.

4. The image forming apparatus according to claim 3, wherein the control section comprises a storage section in which an avoidance condition is stored in advance, and wherein the avoidance judging section judges whether or not the avoidance should be performed based on whether or not the pressed time obtained by the pressed time measurement part and the temperature obtained by the temperature detection part satisfy the avoidance condition.

5. The image forming apparatus according to claim 1, wherein the detection device is an optical sensor comprising a light emitting part and a light receiving part.

6. The image forming apparatus according to claim 1, wherein until the completion of the avoidance is decided by the first decision part, the first avoidance continuation judging section repeatedly forms the detection toner image by the first formation part and repeatedly makes decisions on the necessity for continuation of the avoidance based on the difference between the toner attachment amounts obtained by the first decision part.

7. An image forming apparatus comprising:

an image carrier;

a toner image formation mechanism for forming a toner image on the image carrier;

a transfer member, provided at a position at which the transfer member can be pressed against the image carrier, for transferring the toner image, formed on the image carrier, onto a transferred material;

a detection device for detecting a toner attachment amount of the toner image formed on the image carrier; and a control section, wherein the control section comprises:

an avoidance judging section for judging whether or not avoidance of a pressed region should be performed when a toner image for image formation is formed on the image carrier, the pressed region serving as a region located on the image carrier and being pressed against the transfer member from the end of a previous image forming operation to the start of a present image forming operation; and a second avoidance continuation judging section for judging the necessity for continuation of the avoidance by being operated when it is judged by the avoidance judging section that the "avoidance should be performed", and wherein the second avoidance continuation judging section comprises:

a recognition part for recognizing the position of the pressed region;

a second formation part for forming a detection toner image on the pressed region by the toner image formation mechanism;

a second detection part for detecting, by the detection device, a toner attachment amount of the detection toner image formed on the pressed region; and a second decision part for deciding the number of continuations of the avoidance based on the toner attachment amount.

8. The image forming apparatus according to claim 7, wherein the second detection part detects toner attachment amounts of the pressed region at a plurality of positions arranged in a widthwise direction of the image carrier, and wherein the second decision part decides the number of continuations of the avoidance based on the smallest one of the toner attachment amounts detected at the plurality of positions arranged in the widthwise direction.

9. The image forming apparatus according to claim 7, wherein the avoidance judging section comprises:

a pressed time measurement part for measuring time during which the transfer member is pressed against the image carrier between the end of the previous image forming operation and the start of the present image forming operation; and a temperature detection part for detecting a temperature of inside of the image forming apparatus, and wherein a judgment on whether or not the avoidance should be performed is made based on the pressed time obtained by the pressed time measurement part and the temperature obtained by the temperature detection part.

10. The image forming apparatus according to claim 9, wherein the control section comprises a storage section in which an avoidance condition is stored in advance, and wherein the avoidance judging section judges whether or not the avoidance should be performed based on whether or not the pressed time obtained by the pressed time measurement part and the temperature obtained by the temperature detection part satisfy the avoidance condition.

11. The image forming apparatus according to claim 7, wherein the detection device is an optical sensor comprising a light emitting part and a light receiving part.

12. The image forming apparatus according to claim 7, wherein the control section comprises a storage section in which the number of continuations of the avoidance set in advance for a toner attachment amount is stored, and wherein the second decision part decides the number of continuations of the avoidance based on: a toner attachment amount; and the number of continuations of the avoidance stored in the storage section.

* * * * *